US008579459B2

(12) United States Patent
Ma et al.

(10) Patent No.: US 8,579,459 B2
(45) Date of Patent: Nov. 12, 2013

(54) DOUBLE-WALLED ILLUMINATED CONTAINER

(76) Inventors: Chun C. Ma, Ballwin, MO (US); Pu Ma, Dalian (CN)

( * ) Notice: Subject to any disclaimer, the term of this patent is extended or adjusted under 35 U.S.C. 154(b) by 150 days.

(21) Appl. No.: 13/068,627

(22) Filed: May 17, 2011

(65) Prior Publication Data

US 2012/0002404 A1 Jan. 5, 2012

Related U.S. Application Data

(60) Provisional application No. 61/396,026, filed on May 20, 2010.

(51) Int. Cl.
*A45C 15/06* (2006.01)

(52) U.S. Cl.
USPC ..... 362/156; 362/249.02; 362/249.05; 362/363; 362/800; 362/806

(58) Field of Classification Search
USPC ..... 362/101, 154, 156, 249.01, 249.02, 362/249.05, 249.12, 363, 399, 800, 806
See application file for complete search history.

(56) References Cited

U.S. PATENT DOCUMENTS

| | | | | |
|---|---|---|---|---|
| 2,604,579 | A * | 7/1952 | Deneboudes | 362/101 |
| 4,714,985 | A | 12/1987 | Hickey | |
| 4,886,183 | A * | 12/1989 | Fleming | 362/101 |
| 4,926,296 | A * | 5/1990 | Blume et al. | 362/156 |
| 5,019,438 | A * | 5/1991 | Rapisarda | 362/103 |
| 6,059,423 | A * | 5/2000 | Knopick | 362/156 |
| 6,092,905 | A * | 7/2000 | Koehn | 362/101 |
| 6,137,410 | A * | 10/2000 | Sepulveda | 340/568.7 |
| 6,224,234 | B1 | 5/2001 | Demmery | |
| 6,270,233 | B1 | 8/2001 | Holland | |
| 6,591,524 | B1 * | 7/2003 | Lewis et al. | 40/324 |
| 6,789,932 | B2 * | 9/2004 | Healy | 362/154 |
| 8,152,326 | B2 * | 4/2012 | House et al. | 362/154 |
| 2003/0086260 | A1 | 5/2003 | Terrell et al. | |
| 2006/0227538 | A1 * | 10/2006 | Williams | 362/156 |
| 2007/0133195 | A1 * | 6/2007 | Gorton | 362/156 |
| 2007/0236922 | A1 * | 10/2007 | Sheehan et al. | 362/162 |

* cited by examiner

*Primary Examiner* — Ismael Negron
(74) *Attorney, Agent, or Firm* — Paul M. Denk

(57) ABSTRACT

An illuminated bucket is a double-layered or walled carrier, with LED light, or other illuminated source, established between the layered inner and outer walls for the formed carrier. The circuitry for the LED lights includes a battery, and may further include a flasher that allows for blinking of the lights.

6 Claims, 4 Drawing Sheets

DOUBLE-WALLED ILLUMINATED CONTAINER

CROSS-REFERENCE TO RELATED APPLICATIONS

This non-provisional patent application claims priority to the provisional patent application having Ser. No. 61/396,026, having filing date May 20, 2010 .

FIELD OF INVENTION

This invention relates to the use of LEDs provided within an interior spacing of a bucket-like structure that includes both inner and outer walls, with the lighting provided within the perimeter intermediate the container walls, and being illuminated to provide an illuminated glow through the outer wall of the container, while the inner wall of the container provides support for holding a variety of food, candies, and other miscellaneous merchandise deposited therein, while further spacing furnishes means for accommodating the electronic circuitry and controls, such as switches, batteries, relays for blinkers, and the like, in the illumination of the LEDs during application of this merchandise-holding bucket or container.

BACKGROUND OF THE INVENTION

In a Halloween or other holiday event, many children use different shaped receptacles, whether it is paper bags, handled plastic bags, or even different shaped containers, as a carrier for candies, particularly during the Halloween season, when conducting trick-or-treat activities. Almost all of those types of containers on the market are just usually in the form of a bucket, so that when the children use those buckets as a candy carrier, they still walk in the dark. While some of the buckets may have some means for illumination, they are rather difficult of structure, and do not project the light exteriorly, to also function as a safety lighting feature, to not only add to the security of the children during usage, but to also add to the decorative attractiveness of the container during application.

Examples of some of the prior art types of lighted carriers can be seen, for example, in U.S. Pat. No. 6,224,234, which shows a singular-walled, hollow carrier incorporating a handle, and in a space having a light and diffuser assembly, generally structured to provide for reflection of light into the carrier for illuminating the carrier interiorly, during usage.

The prior U.S. Pat. No. 6,270,233, is also upon an illuminated bucket, which is formed as just that, a bucket that has an illumination means, once again located in the bottom of its structure, which does provide some illumination for the path of the child holding the bucket, with some degree of illumination within the bucket to provide aesthetic effects.

The patent to Hickey, U.S. Pat. No. 4,714,985, shows a trick-or-treat carrier with a false bottom. This carrier also is shaped as a bucket, and has means for holding an inverted flashlight to the bottom of the bucket, for illuminating downwardly, as occurs with most of the prior art described herein, and then has a false bottom that slides down over the flashlight to separate the lower end of the light from the candies or other gifts arranged therein during usage.

Another prior patent in the U.S. Pat. No. 6,789,932, shows an illuminated carrier employing fiber optics. This decorative carrier is also for holding Halloween candy, and it is just a singular bucket that has fiber optics located through its surface, and other light sources projecting through the outer wall of the carrier, so as to provide some decorative illumination of the carrier during application. The patent states that an audible emission may also be provided.

A published application in the U.S., No. 2003/0086260, is upon an illuminated Halloween candy carrier. This carrier is shaped as a face, has a handle that is illuminated by a plurality of light bulbs, and a base structure that is further illuminated by a single bulb, battery-energized, during its usage and application. It does describe its applicability to increase the visibility of the child carrying it on a darkened street.

SUMMARY OF THE INVENTION

This invention comprises an illuminated carrier for candy or other treats, or merchandise, collected by children during participation in holiday events, and more specifically, describes a bucket that may be tailored or designed for the particular holiday involved, whether it be Halloween, Easter, or the like, when children have a tendency to collect such merchandise, but do so with a carrier that is uniquely illuminated so as to provide a translucent display from internally of the bucket, through its combined inner and outer walls, to add attractiveness to the carrier during usage, and to furnish some degree of illumination of the surrounding area for safety purposes.

This invention includes a carrier, having an outer surface wall formed as a bucket, or configured into other shapes, and then incorporates an inner wall, for the location of illumination means, such as lights, and more specifically, light-emitting diodes, intermediate of the said walls, to furnish a translucent display of illuminated light through the outer wall of the carrier, and also through the inner wall thereof, for not only providing illumination to the surrounding area, but visually displaying any caricature that may be provided upon the outer wall surface, for its reflection and observation, while likewise illuminating the interior of the bucket, through its inner wall, so the child can see what has been collected and accumulated during participation in the holiday event.

The same spacing between the inner and outer walls of the bucket can hold the various energy sources, such as batteries, and circuitry, including switches, that may provide for the turn on or off of the light source, for usage or after application. Furthermore, relay means may be provided within the circuitry to provide for the breaking of the light source, as a blinking of the light, or select of the light source, so as to add to the attractiveness and novelty of the displayed carrier, during usage.

It is, therefore, the principal object of this invention to provide an illuminated lantern bucket, that provides not only aesthetically pleasing looks, but also furnishes and provides an illuminated source of light along the path so as to avoid any accident and incident injury.

Another object of this invention is to provide an illuminated lantern carrier that may have strategically located LEDs within the walled interior of the bucket, throughout its height, so as to furnish illumination that is aesthetically pleasing, and likewise adds to the safety of application of the carrier, without exposing the child to any heated lamps, during usage and application.

Another object of this invention is to provide an illuminated lantern carrier that can be made to different shapes, such as like a pumpkin, on Halloween, or even a rabbit, at Easter, in order to enhance the versatile usage and application of this carrier, throughout the many seasons.

Still another object of this invention is to provide a trick-or-treat candy carrier, in a lantern, that can function to provide for conveyance of collected treats, but at the same time furnish peripheral illumination in all directions because of the location of the light source around the inner perimeter of the formed bucket.

Still another object of this invention is to provide a carrier, formed as a lantern, that can help children see the path of walking clearly so as to avoid any accident, and likewise, furnish enough illumination so as to allow anyone in the vicinity, such as the driver of a vehicle, to see the child during the dark of evening.

These and other objects may become more apparent to those skilled in the art upon review of the summary of the invention as provided herein, and upon undertaking a study of the description of its preferred embodiment, in view of the drawings.

DESCRIPTION OF THE PREFERRED EMBODIMENT

The structure of this current invention is to provide a carrier structured as a bucket, incorporating inner and outer walls, having all of the electrical circuitry and energy source provided intermediate thereof, in addition to an array of light-emitting diodes (LED) that are arranged generally around the perimeter of the carrier, in addition to decoratively displayed along various walls of the carrier, so as to furnish pleasing aesthetics to the viewer in proximity with the carrier of the bucket, during its usage and application. Such a bucket is generally used around holidays, such as Halloween, and can be used for the collection and conveyance of treats, such as candies, and other collected merchandise, given out while trick-or-treating, particularly with respect to its usage on Halloween. It is likely that the illumination of the LEDs, or some of them, may even be subject to relays or automatic switches that can provide for their blinking, so as to further add to the attractiveness of the lighted container. In addition, the light source not only furnishes illumination in the surrounding region, but likewise interiorly of the carrier, so the child can see what has been collected and, likewise, provides enough ambient light within the surrounding region so as to add to the safety of the child so that others, such as drivers, can see them, and likewise illuminates a path of travel for the child, during usage of this development.

EXAMPLE 1

The Double-Layered Lantern Bucket

Figure 3:
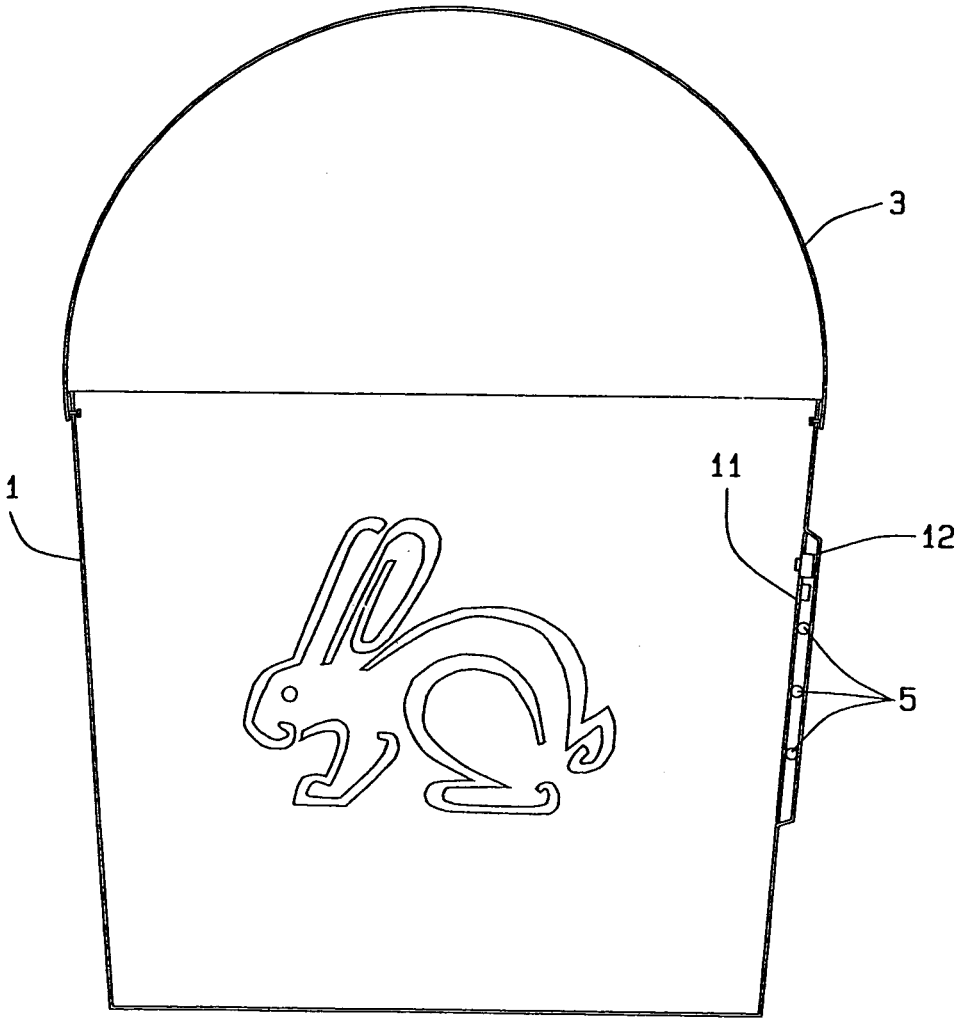
FIG. 3 shows a lantern bucket formed as a double wall and having the lights and circuitry furnished along the region of the side wall, formed as both an inner and outer wall of the shown carrier.

Referring now to FIG. 3, a sectional side view of the illuminated lantern bucket with a layer bucket walled body, as shown. The lantern bucket or carrier is in the form of a bucket or wall 11, and an outside bucket or wall 12, held together by at least their upper flange, and includes a bail-type carrying handle 3, attached in a swiveling fashion to the bucket, for the convenience of its conveyance. The inside wall of the bucket and its outside wall are connected on the top by flanges, and may be held by any type of a adhesive, or screw, as can be noted. There is a space between the two outer and inner walls of the shown bucket as it extends around the circumference of the bucket. The outside wall of the bucket is made from a transparent or translucent material, so as to allow for light to be diffused and disseminated therefrom. The outer wall may include different Halloween or other holiday patterns, on the outer wall of the bucket, or it may include any type of a print or molded relief, on the outside wall of the bucket, that can be seen upon transmission of the inner lights.

Figure 2:
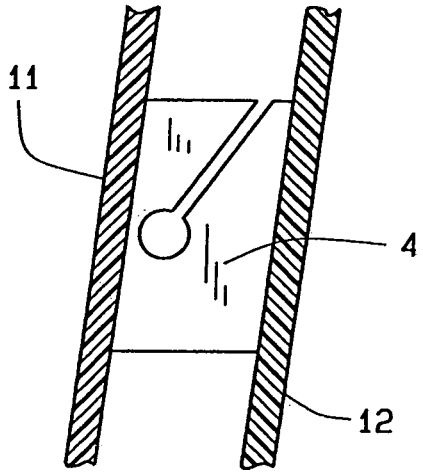
FIG. 2 is a side sectional view of a portion of the carrier showing the inner and outer walls and an installed LED intermediate thereof.

As further described, and as noted in FIG. 2, there are sets of calipers that are built between the layers of the outer and inner walls of the carrier, and there are a variety and plurality of such calipers, which actually function as the spacers, around and intermediate the walls of the bucket, and between the bottom walls of the formed bucket, as can be noted. These spacers can hold the bucket walls in place. The LED lights 5 are operatively associated with each caliper or spacer, and are wired in place, through the circuitry of this structured device. It is particularly to be noted that the spacers and LEDs are arranged intermediately between the inner and outer walls of the entire bucket, as. along its side walls, and perhaps its bottom wall, as can be seen.

There is a battery compartment, and a cover for the battery compartment, that is formed and applied at the bottom of the bucket, and a battery, of any of the variety of sizes that can be used for illuminated lighting of this type, is included, as noted. There is also an on and off switch on the battery compartment, or such switch may be located at the top of the bucket, for the convenience of its turn off, or turn on, generally as noted at 6*a*.

EXAMPLE 2

The Lantern Bucket is Part Double-Layered

Figure 1:
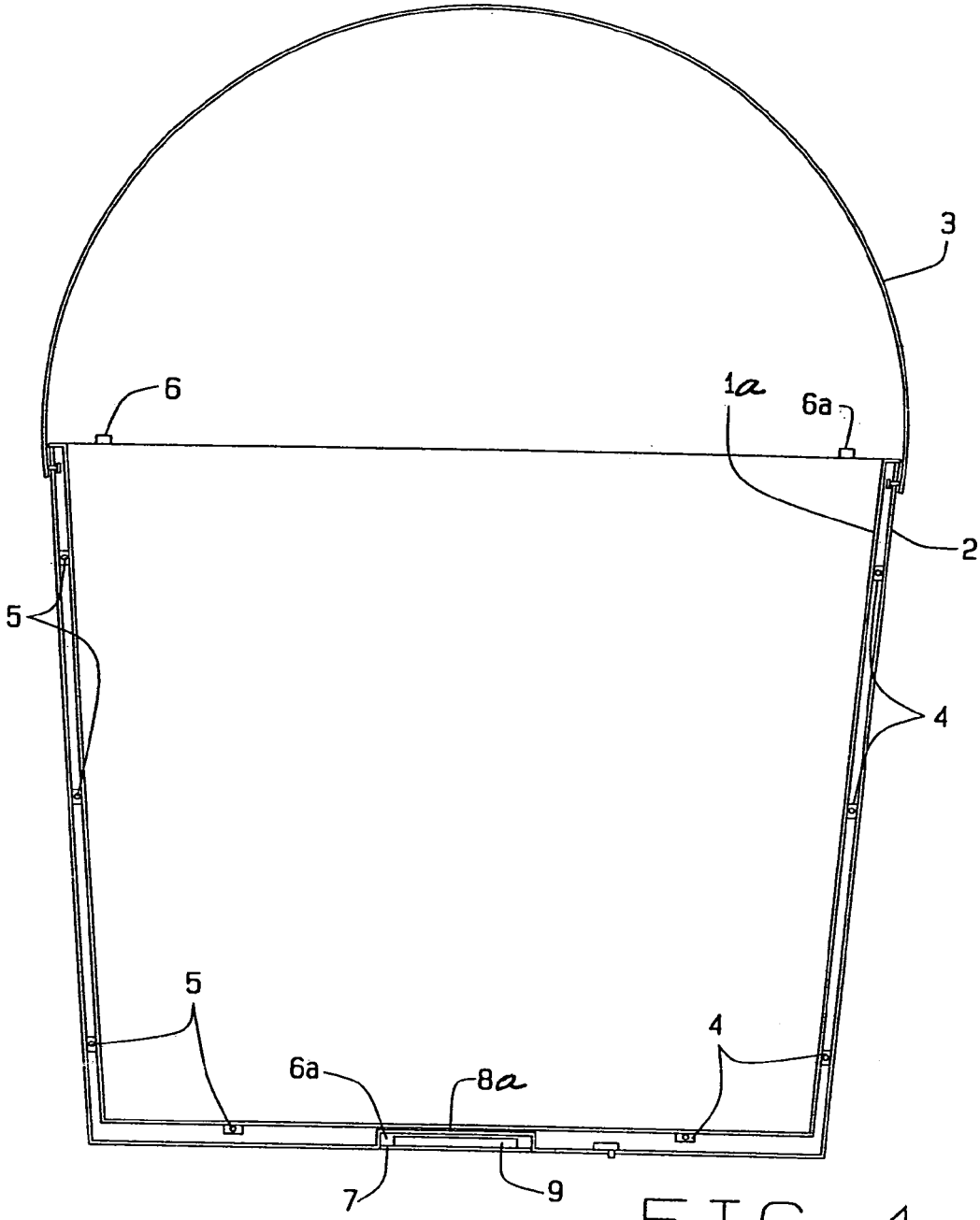
FIG. 1 is a transverse sectional view through the holiday lantern carrier of this invention.

The lantern bucket or carrier with part of its double layering can be seen in FIGS. 1 and 2. The lantern carrier is in the form of the bucket body 1, as noted, with an upper carrying handle 3, as can be seen. The body of the bucket is made from a transparent or translucent polymer material, as noted. Part of the body is a double-layered structure, formed of the inside wall 1*a*, and an outside wall 2, that provides a space therebetween. There may be a Halloween pattern, or, perhaps, even an Easter pattern, et al, provided upon the outside wall 2 of the bucket structure. The inside wall 1 can be removed, that provides for a set-up of the LED lights 5, which may be for a segment of the outer wall, or may extend all the way around its perimeter, proximate the mid-point of the bucket height, or along the entire length of the bucket, as can be noted. The lights 5 will be set up so as to follow a particular pattern. The battery compartment 8 with its switch 6A can be structured into the inner side wall, or the bottom of the bucket, as previously reviewed. Various forms of batteries, such as the usual A batteries, or disc batteries, can be used to furnish the electrical energy necessary to illuminate the light sources, such as the LEDs, and normally can provide, through testing and usage, approximately three hours of illumination without change.

EXAMPLE 3

Figure 4:
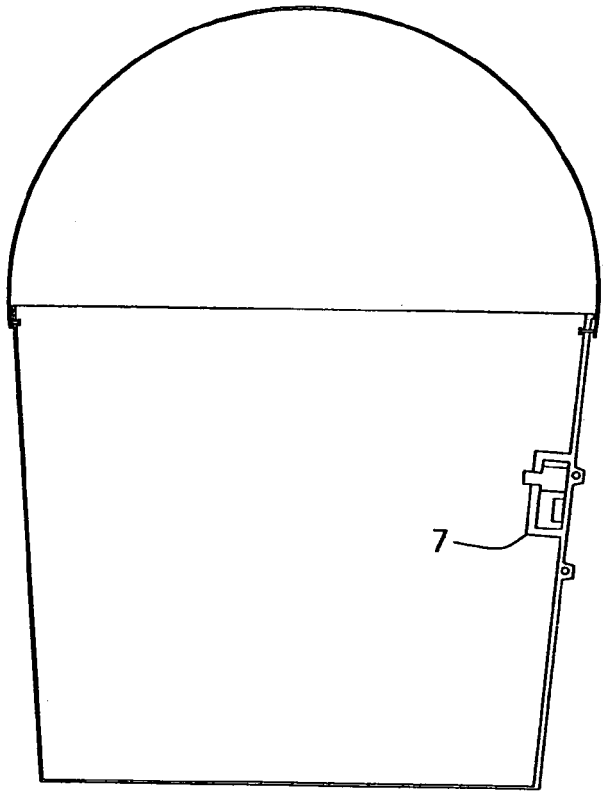
FIG. 4 shows the lantern bucket and carrier including the LED lights and wiring that are cast-formed within the inner and outer walls forming the double layers for the sidewall of the shown bucket.

The Lantern Bucket with LED Lights and Wire is Casted Within the Double-Layered Inner and Outer Walls of the Shown Carrier The lantern bucket or carrier with its LED lights, or other illuminating source, in addition to its wiring, is casted formed inside the wall for the shown bucket, as noted in FIG. 4.

The lantern bucket or carrier is in the form of a bucket body, as noted, with a handle 3 extending upwardly therefrom. The body of the bucket is made from transparent or translucent materials. The lights 5 and the wire are casted and form the inside wall of the bucket body. The lights 5 are arranged in a pattern as may be desired. There is also the formed battery compartment 7, with a cover 8*a* for the battery compartment, the batteries 9 are located therein, and a convenient switch, as at 6A, provides for the turn-on or turn-off of the LED light source.

EXAMPLE 4

Figure 5:
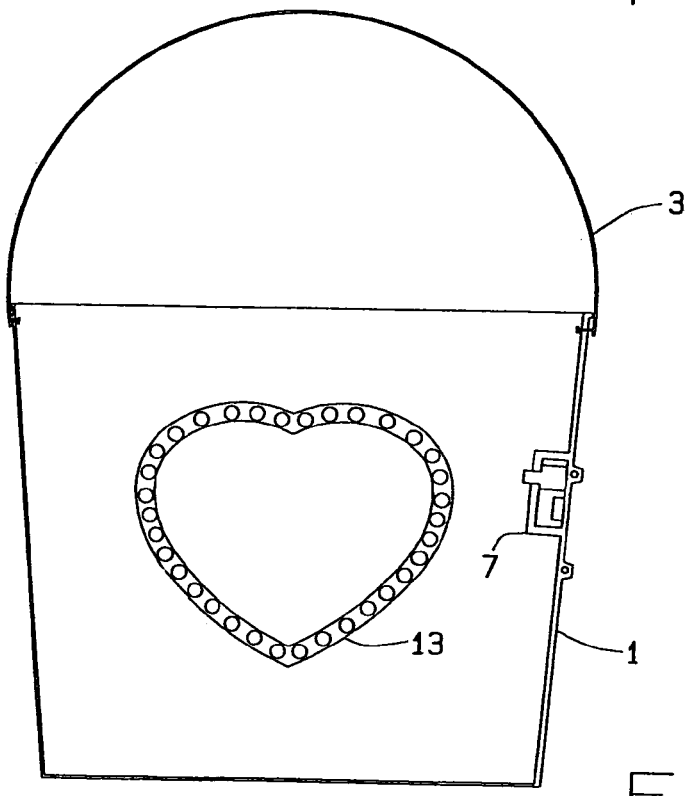
FIG. 5 shows a lantern bucket which is the illuminated source for a micro LED lighted ribbon arranged intermediate of the inner and outer walls of the formed bucket, and also showing the operative switch and circuitry for illumination of the LED lights during usage.

The Lantern Bucket with the Illuminated Source is a Flexible Transparent Sealed Micro-Lighted Ribbon The lantern carrier, with its illuminated source of lighting, is a flexible transparent sealed micro-lighted ribbon 13, such as embodying a series of LEDs that may be shaped into a particular configuration, such as the heart as noted in FIG. 5, and may be used, for example, for a holiday such as Valentine's Day. The lantern carrier is in the form of a bucket body 1 with the handle 3 noted extending upwardly therefrom, as can be seen. The flexible transparent sealed micro-lighted ribbon 13 will be arranged between the inner and outer walls of the formed carrier. The ribbon may be applied to the inside of any outer wall of the bucket, or adhere to its inner wall, but nevertheless, will be held in its configured shape and displayed when embodied within the carrier structure. There may also be the battery container 7, a cover 8*a* for the battery container, and incorporates its various batteries 9 and switch 6*a*, in its structure.

It is also likely that the lantern bucket, with its illuminated light source, may include some fluorescent material, which may be coated on the outer wall of the bucket, to furnish an illuminated source of a fluorescent material coating that substantially enhances the light generated during usage of this carrier. The lantern bucket is obviously in the form of a bucket body and handle, the body will include inner and outer walls, and the bucket can be illuminated within the body from a light source, such as LEDs, which helps to enhance the transmission of a glowing light from the fluorescent material, during usage of the carrier. Such material may also obtain its energy from the sunlight, or any other artificial light, or even from the illumination provided by the LEDs, as explained, where additional light may be desired, from the usage of such fluorescent material, during application of the carrier. In addition, this adds to the safety of the appliance.

Figure 6A:
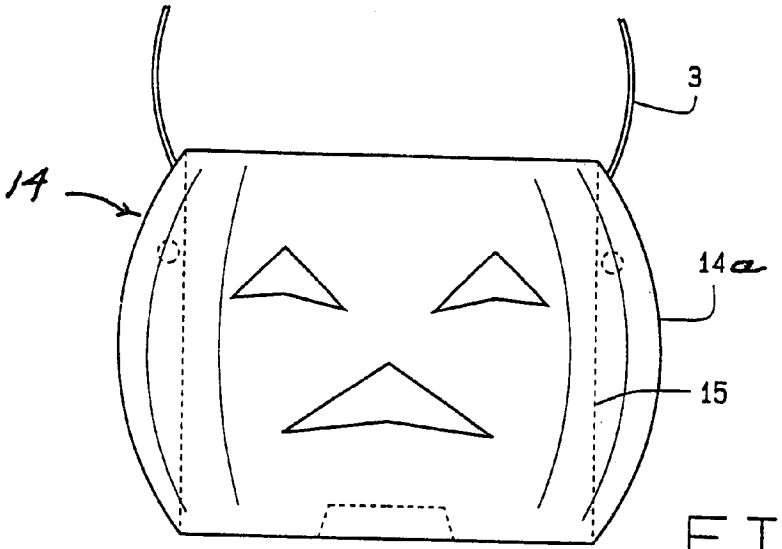
FIGS. 6A, 6B and 6C show the formation of the carrier with an outer arcuate surface representative of a lantern, and having displayed indicia thereon, and an inner wall of the bucket for the formed carrier that locates therein, and has the plurality of LED lights arranged around the perimeter of the carrier intermediate is formed inner and outer walls thereof.
Figure 6B:
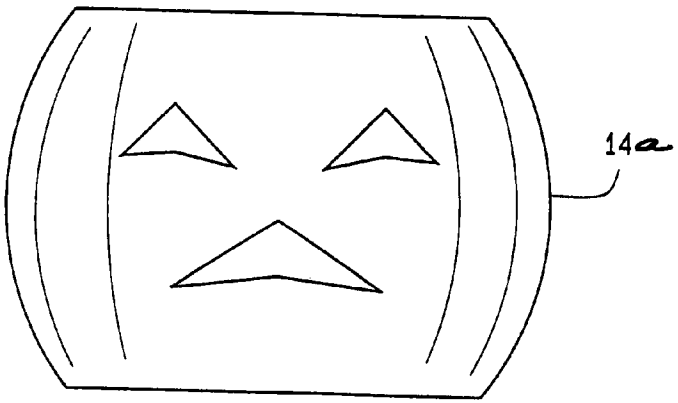
Figure 6C:
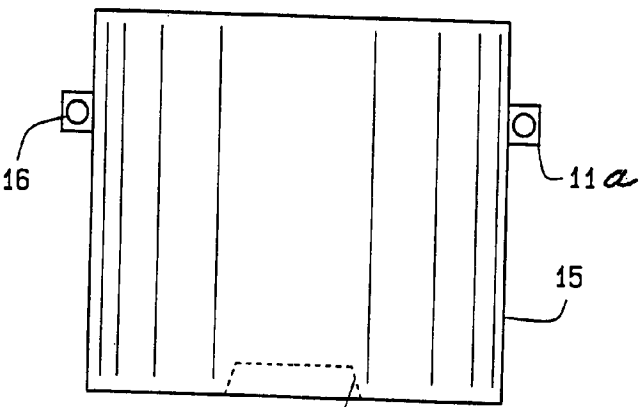

FIG. 6 shows another preferred embodiment for the structure of the carrier 14 of this invention. It includes an outer arcuate shaped wall 14*a*, that may undertake the configuration of a pumpkin, or Halloween lantern, and contains interiorly thereof a cylindrically shaped bucket, as at 15, that is arranged within the structured carrier, in the manner as can be seen in FIG. 6A. FIG. 6C shows how various LEDs 16, supported by their circuit wiring and spacers 11*a*, can be arranged around the perimeter of the inner wall forming the bucket 15, before it is located interiorly of the outer wall 14*a*, as noted. A battery compartment 7 is provided at the bottom of the inner walled bucket 15, and may hold the various batteries, switches, relays, or the like, that may provide for the full or blinking illumination of the LEDs 16, during its usage and application. A handle 3 is also provided, as can be seen. The bucket 15 can be fastened within the outer wall 14, either by any type of fastener, adhesive, or the like. And obviously, as previously described, the battery compartment 7 will be openable, to allow for replacement of the batteries, when they become discharged.

Figure 1A:
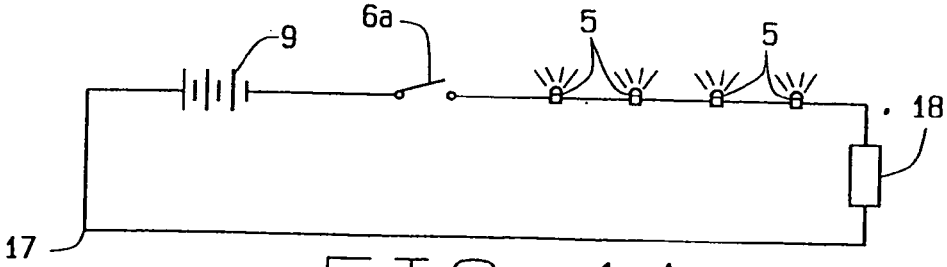
FIG. 1A shows a circuit diagram for the means for illuminating the lights or LEDs for this invention.

The circuit diagram for this invention is generally as disclosed in FIG. 1A. It includes circuit wires 17 and includes in series, a battery 9, and the various LED lights 5, as can be noted. While shown in series, these lights may also be arranged in parallel. A switch 6A provides for turn on or turn off of the lights, during usage. In addition, a form of relay, or semiconductor switch, which allows for the blinking of the lights, is noted at 18. This may be optionally built into the circuitry for this designed carrier.

Variations or modifications to the subject matter of this invention may be considered by those skilled in the art upon review of the structured device as described. Such variations, if within the spirit of this invention, are intended to be encompassed within the scope of any claims to patent protection that may issue upon this development. The depiction of the invention in the drawings, and its description in the preferred embodiment, is set forth for illustrative purposes only.

We claim:

1. A container comprising:

an inner side wall and an outer side wall, secured by a fastener to the inner side wall, a cavity defined between the inner and outer side wall;

a plurality of LEDs provided within the cavity to radiate light externally and internally of the container;

a battery compartment provided within the cavity to house batteries, circuitry, and an on/off switch, to energize the plurality of LEDs in a steady or flashing illumination function;

a carrier operatively associated with an upper edge of the side walls of the container to allow a user to carry the container;

wherein said inner and outer side walls of the container are double-layered, the outer wall including one of transparent and translucent material, and said LEDs being fastened in an arranged pattern intermediate said inner and outer walls of the container; and a series of spacers provided between the inner and outer walls for the carrier, said spacers further providing support for each assembled LED provided within the intermediate space between the inner and outer wall, and also circuitry to the LEDs to provide for their energization and illumination.

2. The holiday light source of claim 1 wherein the LEDs are powered by at least one battery.

3. The container of claim 1, wherein said LEDs provided within the double-layered wall for the formed container are made as a micro-lighted ribbon containing a series of LEDs and shaped into a particular configuration when sealed intermediate the inner and outer walls of the formed container.

4. The container of claim 1 and further including a fluorescent material coated onto the outer wall of the said container to provide for further illumination of a patterned design during usage of the structured container.

5. The holiday lantern container of claim 1 wherein said spacers are set at prearranged height and in a particular design in the spacing intermediate the inner and outer walls for the formed bucket.

6. The container of claim 2, wherein said battery is a disc battery.

* * * * *